United States Patent [19]

DiPaola et al.

[11] 3,937,451

[45] Feb. 10, 1976

[54] HOLDER

[76] Inventors: Philip J. DiPaola, 258 Wadsworth Ave., New York, N.Y. 10040; Charles M. Boye, 300 W. 23rd St., New York, N.Y. 10011

[22] Filed: Mar. 3, 1975

[21] Appl. No.: 554,449

Related U.S. Application Data

[63] Continuation of Ser. No. 390,346, Aug. 22, 1973, abandoned.

[52] U.S. Cl. ..... 269/45; 269/78; 269/97; 403/385

[51] Int. Cl.[2] ..... B25B 5/10

[58] Field of Search ..... 269/45, 74, 75, 76, 77, 269/78, 84, 97; 403/344, 360, 373, 375, 381, 385, 386

[56] References Cited

UNITED STATES PATENTS

| | | | |
|---|---|---|---|
| 1,486,158 | 3/1924 | Price | 269/45 |
| 2,803,208 | 8/1957 | Bernard | 269/45 |

FOREIGN PATENTS OR APPLICATIONS

| | | | |
|---|---|---|---|
| 1,233,609 | 10/1960 | France | 403/385 |
| 955,126 | 12/1956 | Germany | 269/84 |

*Primary Examiner*—Roy Lake
*Assistant Examiner*—Mark S. Bicks
*Attorney, Agent, or Firm*—Oblon, Fisher, Spivak, McClelland & Maier

[57] ABSTRACT

A holder includes a first clamp and a second clamp, the first clamp having a first extension and the second clamp having a second extension, and gripping means having an opening defined therein for receiving the first and second extensions. The opening within the gripping means is of variable size so as to permit rotation of the first and second clamps when the opening is not constricted and to prevent rotation of either the first or second clamps when the opening is constricted, means also being provided to vary the size of the opening within the gripper means. Frictionless washers are interposed between the gripping means and the clamps and the extensions are spaced from each other, even when assembled, so as to facilitate the angular adjustment of the clamps and the workpieces held thereby, the stable support of the device nevertheless being maintained due to the interaction between the gripping means and the clamp extensions.

9 Claims, 2 Drawing Figures

HOLDER

CROSS-REFERENCE TO RELATED APPLICATIONS

This is a Continuation application of Application Ser. No. 390,346 filed Aug. 22, 1973, now abandoned.

BACKGROUND OF THE INVENTION

1. Field of the Invention:

The present invention relates generally to a holder and more particularly to a holder which includes two clamps which operate independently of each other and which may be rotated with respect to each other and locked in a desired position.

2. Description of the Prior Art:

Although numerous clamping or holding devices are known, there appears to be a substantial need for a clamping or holding device which is able to hold more than one workpiece and wherein the workpieces are easily angularly adjustable with respect to each other while being stably supported by the holding device.

While some conventional holding devices are able to simultaneously support more than one workpiece, such devices suffer from various disadvantages, such as, for example, the fact that means are not provided for permitting the workpieces to be angularly adjusted with respect to each other whereby the circumstances under which such devices are capable of being utilized are necessarily limited, or while other types of devices may in fact include means permitting such angular adjustability, the devices include additional structure which is quite complex for adequately supporting the workpieces and the adjustable structure thereof. Such additional structure of course renders the assembly of the devices substantially difficult and the manufacture of such devices considerably expensive.

SUMMARY OF THE INVENTION

Accordingly, it is an object of the present invention to provide an improved holding device.

Another object of the present invention is to provide an improved holding device which is quite simple in structure, easy to assemble, and quite inexpensive to manufacture.

Still another object of the present invention is to provide an improved holding device which is able to support a plurality of workpieces.

Yet another object of the present invention is to provide an improved holding device wherein the supported workpieces may be angularly adjusted with respect to each other and subsequently fixed in a predetermined angular disposition relative to one another.

Yet still another object of the present invention is to provide an improved holding device wherein the angular adjustment of the workpieces is readily facilitated yet the stable support of the workpieces is always maintained.

The foregoing objectives are achieved according to the present invention through the provision of the holding device which includes a first and second clamp, the first clamp having a first extension and the second clamp having a second extension, and gripping means having an opening defined therein for receiving the first and second extensions. The opening within the gripping means is of variable size so as to permit rotation of the first and second clamps when the opening is not constricted and to prevent rotation of either the first or second clamps when the opening is constricted, means also being provided to vary the size of the opening within the gripper means. Frictionless washers are interposed between the gripping means and the clamps and the extensions are spaced from each other, even when assembled, so as to facilitate the angular adjustment of the clamps and the workpieces held thereby, the stable support of the device nevertheless being maintained due to the interaction between the gripping means and the clamp extensions.

BRIEF DESCRIPTION OF THE DRAWINGS

Various other objects, features, and attendant advantages of the present invention will be more fully appreciated as the same becomes better understood from the following detailed description when considered in connection with the accompanying drawings, in which like reference characters designate like or corresponding parts throughout the several views, and wherein.

DETAILED DESCRIPTION OF THE PREFERRED EMBODIMENT

Figure 1:
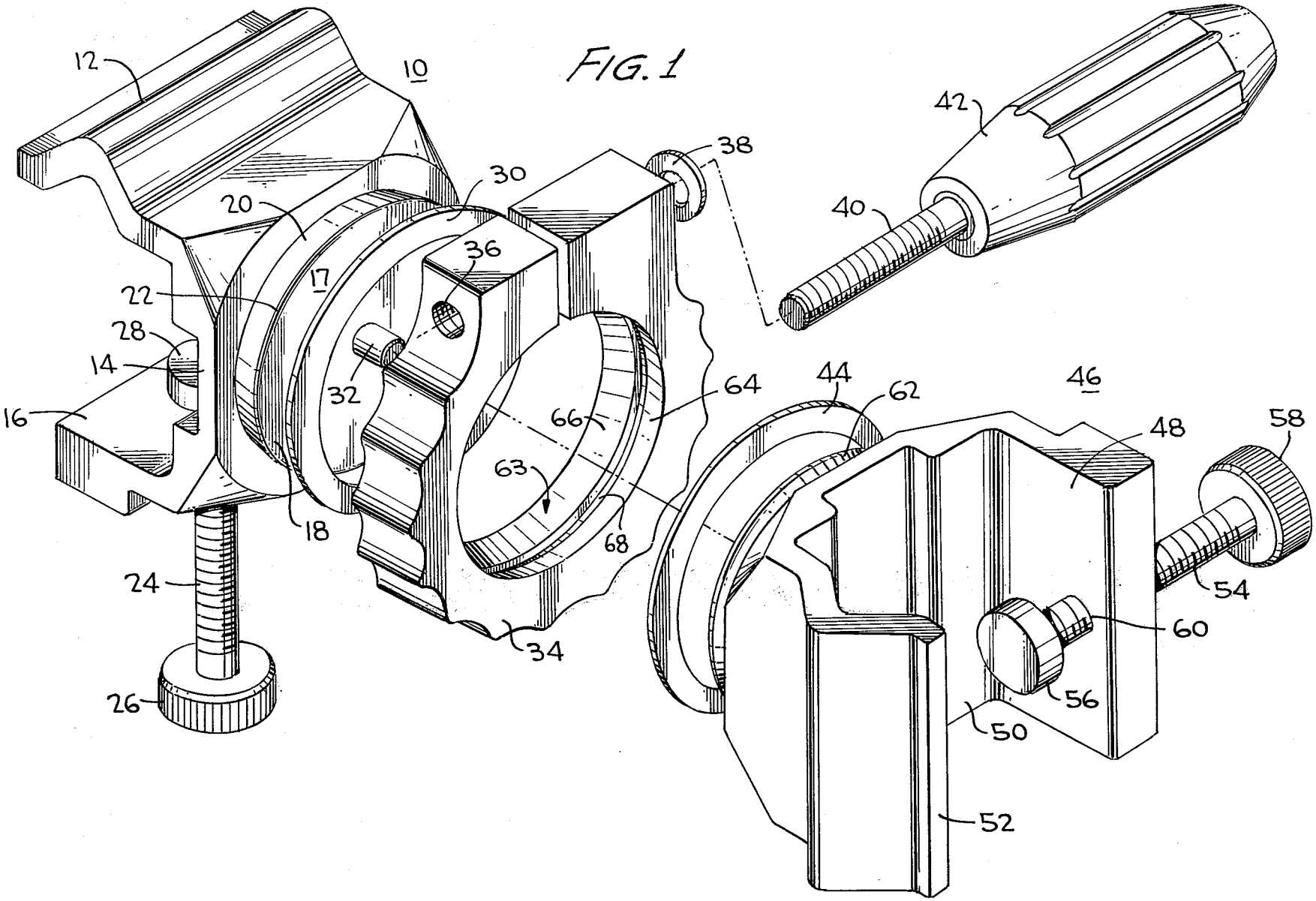
FIG. 1 is an isometric exploded view of the holder of the present invention.

Referring now to the drawings, and more particularly to FIG. 1 thereof, the holder of the present invention is shown as comprising two oppositely disposed clamps 10 and 46 which may be identical, as shown, or alternatively, this need not be the case. Clamp 10 is substantially U-shaped and comprises portions 12, 14 and 16 with portions 12 and 16 being generally perpendicular to surface 14. In a like manner, portions 48, 50 and 52 comprise substantially U-shaped clamp 46 with portions 48 and 52 being generally perpendicular to surface 50.

With reference to clamp 10, a threaded rod 24 having a head 28 and a manual grip 26 is disposed within a threaded opening, not shown, within portion or leg 16 while a threaded rod 54 having a head 56 and a manual grip 58 is similarly disposed within a threaded opening 60 provided within member 48.

As is evident from FIG. 1, an object may thus be securely held between head 28 and the interior surface of member 12 by applying pressure thereto as a result of threadedly rotating rod 24. In like manner, another object may also be held between head 56 and the interior surface of member 52 by applying pressure thereto as a result of rotation of rod 54.

Integrally mounted to the exterior surface of member 14 is an axially extending disc-type extension 17 which is comprised of a radially extending planar surface 18 and a perimetrical surface 20, the surfaces meeting at a rounded edge interface 22. Similarly, extension 62 is integrally mounted to the exterior surface of member 50.

A dowel 32 is centrally located within surface 18 of extension 17 and protrudes therefrom in an axial direction. Dowel 32 is adapted to be received within an opening 72 provided within extension 62 and functions to align extension 17 with extension 62.

A split ring 34 includes a threaded bore 36 within one end thereof and a non-threaded bore, not shown, aligned therewith at the other end of the split ring and centrally defined within split ring 34 is an opening 63 which is comprised of annular sections 64 and 66 and an annular groove 68 interposed between sections 64 and 66.

Figure 2:
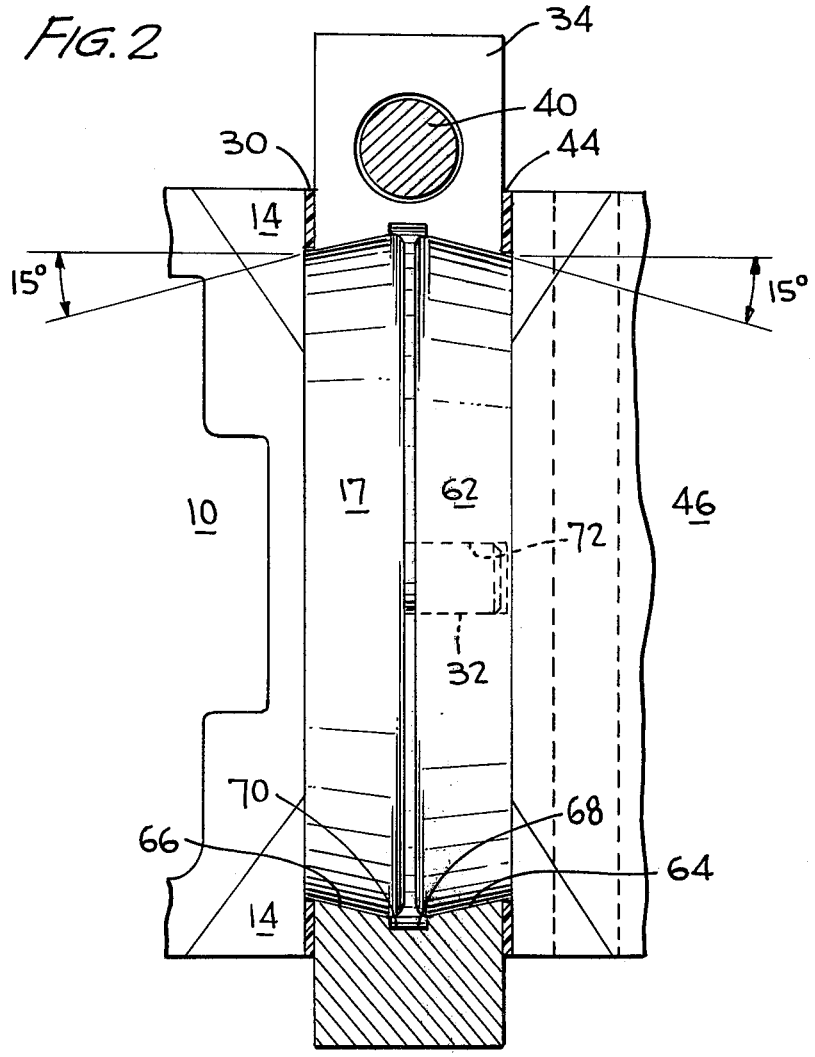
FIG. 2 is a side elevation view partly in cross-section of the central portion of the holder in fully assembled form.

With reference now being made to FIG. 2, extensions 17 and 62 are circumscribed by split ring 34 and this, of course, requires that split ring 34 be constructed of a material that is somewhat flexible. A threaded rod 40 is disposed within the non-threaded bore, not shown, and the threaded bore 36 within split ring 34 so as to threadedly engage the latter bore and thereby permit rotation of a handle 42 and rod 40 relative to ring 34 in order to constrict the ring 34 and alter the size of opening 63 defined by split ring 34. A relatively frictionless nylon washer 38 is interposed between control handle 42 and split ring 34 in order to facilitate rotation of control handle 42 with respect to split ring 34.

As best shown in FIG. 2, opening 63 is comprised of annular sections 64 and 66 and an annular groove 68, sections 64 and 66 being inclined at an angle of approximately 15 degrees toward groove 68, and in order to provide a complimentary fit between ring 34 and extensions 17 and 62, it is noted that the side surfaces of extensions 17 and 62 are similarly inclined at approximately 15°, extensions 17 and 62 having the configuration of a truncated cone. It is also to be noted that within the assembled position, end surface 18 of extension 17 does not abut or contact the end surface, not numbered, of extension 62, even when the ring 34 is fully tightened.

Rotation of clamp 10 about the central axis of extension 17 is facilitated by the provision and interdisposition of a relatively frictionless annular nylon washer 30 between the annular shoulder portion of member 14 defined about extension 17 and between split ring 34 and similarly, rotation of clamp 46 about the central axis of extension 62 is likewise facilitated by the provision of a relatively frictionless, annular nylon washer 44 similarly interposed between split ring 34 and the annular shoulder portion of member 50 defined about extension 62. It is readily apparent therefore that the two clamps are held in fixed relative positions as a result of the pressure brought to bear upon and between the shoulder portion of member 14, nylon washer 30, ring 34, nylon washer 44, and the shoulder portion of member 50, yet the clamps are readily adjustable when split ring 34 is slightly enlarged due to the disposition of washers 30 and 44 as well as the space or gap defined between end surface 18 of extension 17 and the end surface, not numbered, of extension 62.

As noted heretofore, dowel 32, which is integrally attached to extension 17 and which is adapted to be disposed within opening 72 defined within extension 62, maintains clamps 10 and 46 in accurate alignment while nevertheless permitting rotation with respect to each other. In addition, extension 17 and 62 with their angled surfaces are maintained in alignment by means of the complimentarily angled surfaces 64 and 66 of split ring 34. It is quite easy to lock clamps 10 and 46 in their desired relative angular position, once such position has been attained, by constricting the circular opening defined by split ring 34 as a result of rotating control handle 42 so as to cause the split portions of split ring 34 to be drawn toward each other.

Thus, it may be seen from FIGS. 1 and 2 that the holder of the present invention provides a very effective means for uniting two clamps so that they are freely rotatable with respect to each other but which are nevertheless stably maintained in alignment with each other and which are able to be securely locked in a predetermined position at a predetermined angular relationship with respect to each other.

Obviously, many modifications and variations of the present invention are possible in light of the above teachings. It is to be understood therefore that within the scope of the appended claims the present invention may be practiced otherwise than as specifically described herein.

What is claimed as new and desired to be secured by Letters Patent of the United States is:

1. Holding means comprising:

a first clamp having a first extension means integrally formed therewith;

a second clamp having a second extension means integrally formed therewith;

variable sized means for rotatably gripping said first and second extension means whereby said first and second clamps are rotatably secured together so as to be angularly adjustable with respect to one another when said variable sized means is of a first size, and for fixedly gripping said first and second extension means whereby said first and second clamps are fixedly secured together at a selected angular position with respect to one another when said variable sized means is of a second size which is smaller than said first size;

said first and second extensions and said variable sized means being axially aligned;

said first and second extensions being spaced apart from each other by said variable sized means so as to define a gap therebetween when said variable-sized means is either of said first or second size;

a first washer interposed between said variable-sized means and said first clamp;

a second washer interposed between said variable-sized means and said second clamp; and means for varying said size of said variable sized means whereby the adjustability of said holding means and said clamps relative to one another is facilitated by said washers and said gap defined between said extensions, yet said clamps are stably supported with respect to each other by said variable sized gripping means.

2. Holding means in accordance with claim 1 wherein:

said variable sized means is a split ring, said split ring having a threaded bore at one end and a non-threaded bore at the other end, and a threaded rod is disposed within said threaded and non-threaded bores which when tightened constricts the opening of said split ring.

3. Holding means in accordance with claim 2 wherein:

said opening of said split ring is defined by means of annular sections, said first and second extensions each having substantially the shape of a truncated cone and being simultaneously disposed within said annular sections.

4. Holding means in accordance with claim 3 wherein:

said annular sections comprise two angled halves; and said first and second extensions are similarly angled so as to permit said first and second extensions to be complimentarily disposed within and with respect to said two angled halves within said opening.

5. Holding means in accordance with claim 3 wherein:

said annular sections comprises two angled halves with each half inclined at an angle of substantially 15°; and said first and second extensions are similarly inclined at an angle of substantially 15° so as to permit said first and second extensions to be complimentarily disposed within and with respect to said two angled halves within said opening.

6. Holding means in accordance with claim 5 further comprising:

a dowel rididly affixed to said first extension; and an opening defined within said second extension for receiving said dowel, whereby said clamps are maintained aligned with respect to each other.

7. Holding means in accordance with claim 1 wherein:

said first and said second washers are nylon.

8. Holding means in accordance with claim 7 wherein said first and second clamps each comprise:

a first surface, a second surface and a third surface, said first and third surfaces being substantially perpendicularly disposed to said second surface;

a threaded opening defined within said first surface; and a threaded rod passing through said threaded opening so that an object may be clamped between said rod and said third surface.

9. Holding means in accordance with claim 8 wherein:

said second surface of said first clamp is integral with said first extension; and said second surface of said second clamp is integral with said second extension.

* * * * *